US006015059A

United States Patent [19]

Takayama

[11] Patent Number: 6,015,059

[45] Date of Patent: Jan. 18, 2000

[54] CAN WITH SEAL

[76] Inventor: Yoshikazu Takayama, 19-5, Ostuka 5-chome, Sunkyo-ku, Tokyo 112, Japan

[21] Appl. No.: 09/093,139

[22] Filed: Jun. 8, 1998

Related U.S. Application Data

[63] Continuation-in-part of application No. 08/693,528, Aug. 2, 1996.

[30] Foreign Application Priority Data

Aug. 4, 1995 [JP] Japan ..... 7-219576

[51] Int. Cl.[7] ..... B65D 51/22

[52] U.S. Cl. ..... 220/258; 220/269; 220/359.2

[58] Field of Search ..... 220/257, 258, 220/259, 269, 270, 359.1, 359.2, 716, 730, 906

[56] References Cited

U.S. PATENT DOCUMENTS

| | | | |
|---|---|---|---|
| 3,204,805 | 9/1965 | May | 220/257 |
| 3,438,533 | 4/1969 | Hanisch et al. | 220/257 |
| 3,690,509 | 9/1972 | Kinoin et al. | 220/716 |
| 4,708,257 | 11/1987 | Deline | 220/257 |
| 4,927,048 | 5/1990 | Howard . | |
| 5,014,869 | 5/1991 | Hammond . | |
| 5,108,003 | 4/1992 | Granofsky | 220/257 |
| 5,119,955 | 6/1992 | Granofsky | 220/270 |
| 5,292,022 | 3/1994 | Blanco | 220/257 |

FOREIGN PATENT DOCUMENTS

| | | | |
|---|---|---|---|
| 474420 | 8/1968 | Switzerland | 220/257 |

*Primary Examiner*—Stephen K. Cronin
*Attorney, Agent, or Firm*—Dennis G. LaPointe; Mason & Associates, PA

[57] ABSTRACT

A pull top type can with a seal is provided, which is sanitary, can prevent injury of the user, can prevent spattering of the contents and can be re-used. The seal (5, 5A) is attached to the pull top type can (1, 1A) such as to cover the tap.

5 Claims, 4 Drawing Sheets

CAN WITH SEAL

RELATED APPLICATION

This application is a continuation in part of U.S. patent application Ser. No. 08/693,528 filed Aug. 2, 1996.

BACKGROUND OF THE INVENTION

1. Field of the Invention

This invention relates to pull top type cans for canned beer and canned juices and, more particularly, to a can with a seal covering an openable tap.

2. Description of Related Art

FIG. 11 shows a prior art pull top type can, in which beer or other drinks is sealed. As shown, the can comprises a cylindrical can body 1 with a bottom. Its top has a pull top member 3, which can be raised by pulling and raising the pull top member 3 for drinking the contents, a tearable lid 6*a* is teared and brought into the can, thus forming an opening 6 as a tap.

As shown in FIG. 11, when unclean contaminant (a) is attached to a can top portion near the tap, it may enter the can when the tap is opened, or it may enter the body of the person who drinks the contents. Sometimes, the contaminant may induce a disease.

Another problem is that the edge of the opened tap is sharp like a razor and may injure fingers. Particularly it is dangerous for infants and children.

At present, the product liability regulations concerning the responsibility of products are enforced, and the manufactures have to provide some measure for solving the above problem.

As shown in FIG. 12, a further problem is that the contents of the can may be scattered to the outside to contaminate garments or nearby things when operating the pull top member 3 while walking or in a rocking train or in a tilted state of the can or in dependence on the way of applying a force to the pull top member 3 for raising.

In a different type of can, a thin plastic lid is merely fitted on the can top. Such a lid is easily detached during transport or handling of the can. Besides, once the lid is detached, it can no longer be fitted right.

One prior art device is a hygienic mouth protector (U.S. Pat. No. 3,690,509) which provides a seal with adhesive such as a gum arabic over the lid portion of a can. However, the seal adhesive and features of the seal do not allow for re-adhesion and reuse and the device does not incorporate anti-bacterial properties. It serves merely as a hygienic protector of the lid area between manufacture until first consumed. The seal is adhesively applied under sterilized conditions; however sterilization does not continue once the seal is first removed. Further, the prior art structure in U.S. Pat. No. 3,690,509 discloses an upper portion connected to a tear-strip over the can opening wherein the upper portion is pulled-up together with the mouth protector and tear-strip, thus allowing beverage to easily splash out or flow through the can opening during the protector and tear-strip removal step.

SUMMARY OF THE INVENTION

The invention was made in view of the above problems, and its object is to provide a can with a seal, which is sanitary, can eliminate occasional damage, can prevent scattering of the contents and is capable of reuse.

A feature of the invention to attain the above object is to provide a can with a seal, the can having a top lid with a pull top member, the seal being provided on the inner side thereof with an adhesive and attached to the can such as to be able to be peeled off, the seal converting a tap capable of being opened by pulling and raising the pull top member.

The seal is substantially semi-circular or circular and has a pull portion.

The seal is an anti-bacterial seal.

The adhesive contains an anti-bacterial agent.

The seal has a pleat portion to be bonded to the can depending from its arcuate edge and extending down to a portion to be touched by the lower lip.

BRIEF DESCRIPTION OF THE INVENTION

For a fuller understanding of the nature and objects of the invention, reference should be made to the following detailed description, taken in connection with the accompanying drawings, in which.

DETAILED DESCRIPTION OF THE INVENTION

Figure 1:
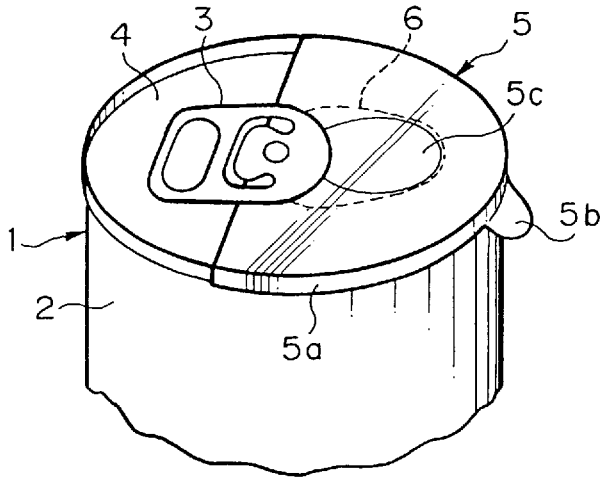
FIG. 1 is a fragmentary perspective view showing an embodiment of the invention.

FIG. 1 is a fragmentary perspective view showing an embodiment of the invention. Referring to the FIGURE, designated at 1 is a usual can, such as an aluminum can. The can 1 comprises a cylindrical body 2 with a bottom. Fitted on the top of the can body 2 is a disc-like lid 4 with a pull top member 3 having a well-known structure.

Designated at 5 is a seal made from a film, an aluminum foil, etc. The seal 5 is substantially semi-circular in shape, and has a pleat portion 5*a* extending downward from its arcuate edge. The pleat portion 5*a* can substantially cover the lid 4. Although not shown, the seal 5 is at least partly crown-like and covers a peripheral portion of the can 1 to be contacted by the lower lip. This arrangement is very sanitary. The seal 5 has a pull portion 5*b* formed substantially at the center of its arcuate edge. The seal 5 can be pulled up from the can 1 by pinching the pull portion 5*b* with fingers. The seal 5 has a window 5*c* formed substantially in a central portion of its top and made of a transparent or semi-transparent material. The window 5*c* may have any shape and also any size so long as it permits the state of opening 6 to be readily seen from the outside.

Figure 2:
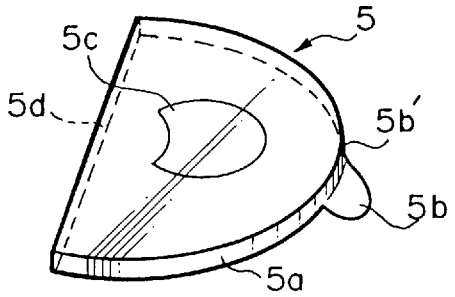
FIG. 2 is a perspective view showing a seal used in the embodiment of the invention.

FIG. 2 is a perspective view showing the seal 5. As shown shaded, an adhesive of a type capable of being relatively readily applied to and separated from the bonding surface and also capable of being re-used, is coated on the inner surface of the pleat portion 5*a* and also the inner surfaces of a stem portion 5*d* of the pull portion 5*b* and a straight edge portion 5*b*' and, as shown in FIG. 1, the seal 5 is provided to cover substantially one half of the lid 4, which as the tap 6 capable of being opened by the pull top member 3. It is possible to coat the adhesive on the entire inner surface of the seal.

The seal 5 may be made of any material. The material, however, is required to be strong with respect to water and difficult to break. Suitably, the material is anti-bacterially treated and has anti-bacterial properties, because the content of the can is taken into the body through the mouth. The anti-bacterial treatment may be made by coating or coatingly introducing an anti-bacterial agent, which is effective for colon bacilli, MRSA (methicillin-resistant *Staphylococcus aureuses*), Salmonella, etc., or into at least a portion of the inner surface of the seal 5 adjacent the tap. Of course it is possible to subject the entire inner surface of the seal to the anti-bacterial treatment. Where the seal 5 is made of an opaque material, the window 5*c* of a transparent or semi-transparent material as noted above is provided for observing the portion 6 corresponding to the tap. Where the seal 5 itself is made from a thin transparent or semi-transparent film, however, it is not necessary to provide the window 5*c*. In place of using an anti-bacterial seal, the anti-bacterial agent may be introduced into the adhesive itself to prevent intrusion of bacteria from the outside.

Figure 3:
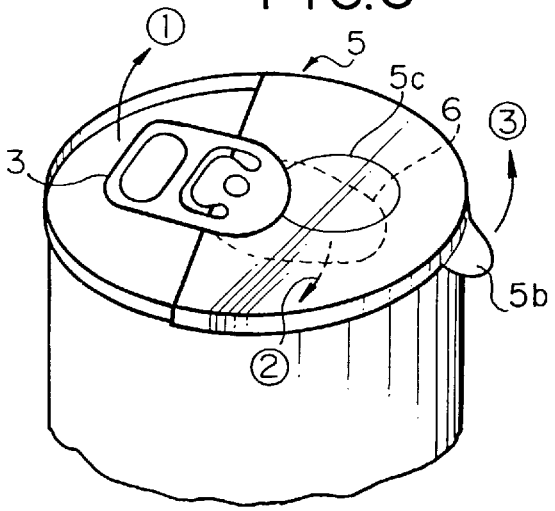
FIG. 3 is a view illustrating the procedure of opening the embodiment of the can according to the invention.
Figure 4:
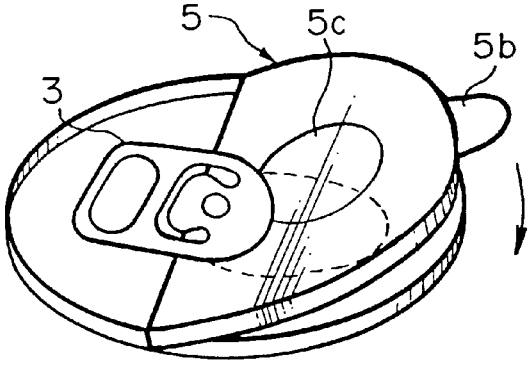
FIG. 4 is a view showing the can having been opened to be ready for drinking the contents.

FIG. 3 shows the way of opening the can with the seal. First, the pull top is raised as shown at (1). In an interlocked relation to this operation, the portion 6 is brought into the can, thus opening the tap. This state can be readily confirmed through the window 5*c* of the seal 5 made of an opaque material. In this stage, the tap is covered by the seal 5 to prevent attachment of contaminant to it. At this step, the seal remains attached thus preventing any immediate splashing out or flowing out of its contents. Subsequently, the pull portion 5*b* is raised by pinching it with fingers. As shown in FIG. 4, the tap is exposed as a result, so that it is ready to drink the content.

When the content has been fully drunk, the seal 5 may be returned downward to cover the tap again. By so doing, it is no longer possible that fingers are cut by the sharp edge of the tap.

When it is desired to reserve the remainder of the content after drinking some thereof, the can may be sanitarily kept in a refrigerator or the like after closing the tap 6 with the seal 5 and securing the seal to the can by making use, for instance, of a residual adhesive force of the adhesive. The seal 5 may be utilized as a display section as well by writing necessary description of the like on it.

Figure 5:
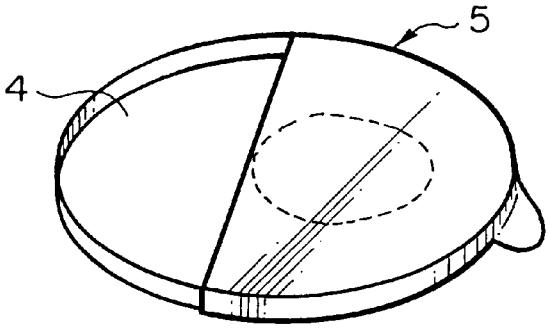
FIG. 5 is a view illustrating a procedure of attaching the seal according to the invention.
Figure 6:
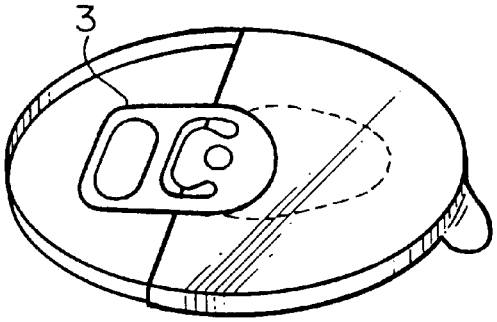
FIG. 6 is a view illustrating a continuation of the procedure of attaching the seal.

FIGS. 5 and 6 illustrate an example of the procedure of attaching the seal 5. As shown in FIG. 5, the seal 5 is first applied by using an adhesive such as to cover substantially one half of the lid 4. Then, as shown in FIG. 6, the pull top member 6 is attached to the top of the can to seal the can.

Figure 7:
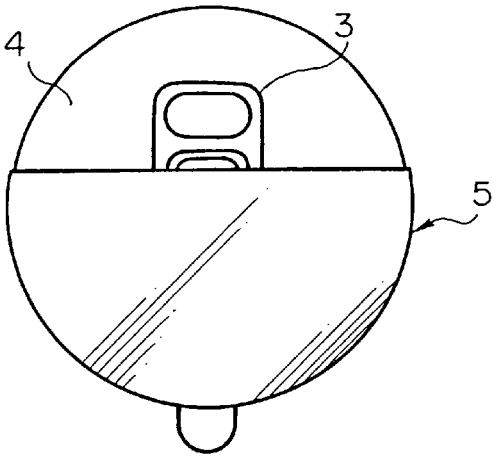
FIG. 7 is a view illustrating a different procedure of attaching the seal according to the invention.

FIG. 7 shows another example of attaching the seal 5. In this case, the seal 5 is applied after attaching the lid 4 with pull top member to the can. In this example, the stem of the pull top member 3 is covered as well by the seal 5. However, the seal 5 may be of the shape as shown in FIG. 1 as well.

Figure 8:
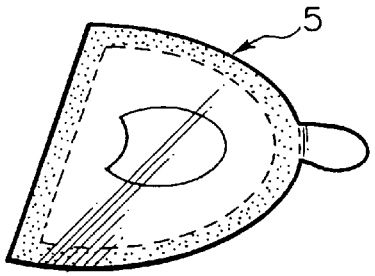
FIG. 8 is a view showing a different example of the seal according to the invention.
Figure 9:
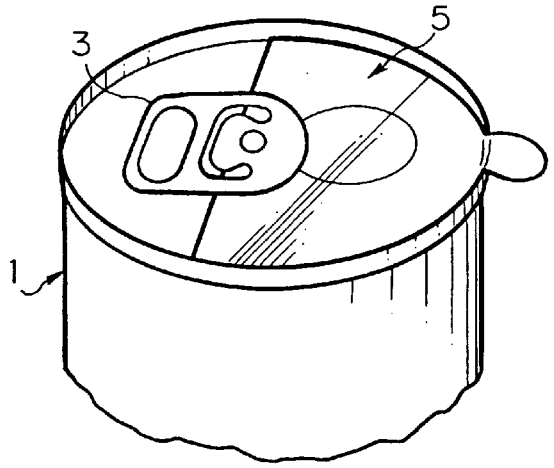
FIG. 9 is a view showing a different embodiment of the invention.

FIG. 8 shows a different example of the seal 5. This example of the seal 5 does not have the pleat portion 5*a* as shown in FIG. 2. As shown in FIG. 9, in this case an inner edge portion is applied to the lid 4. Shown shaded in FIG. 8 is a portion, to which the adhesive is provided. While the seal 5 described above has been substantially semi-circular in basic shape, the seal may as well cover more than one half of the lid or have a different shape.

Figure 10:
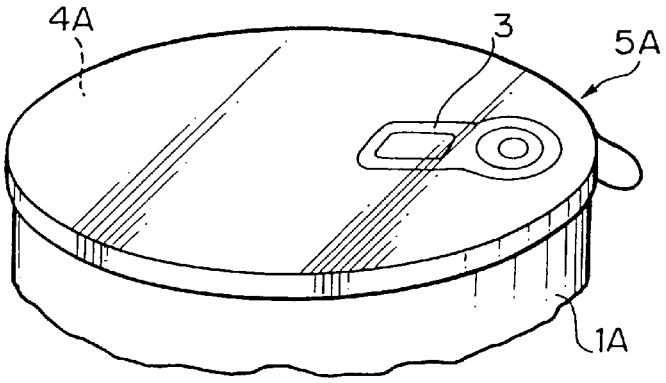
FIG. 10 is a view showing a further embodiment of the invention.
Figure 11:
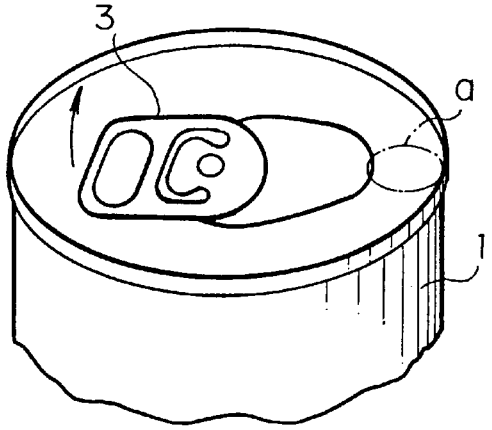
FIG. 11 is a view showing a prior art can with a seal.
Figure 12:
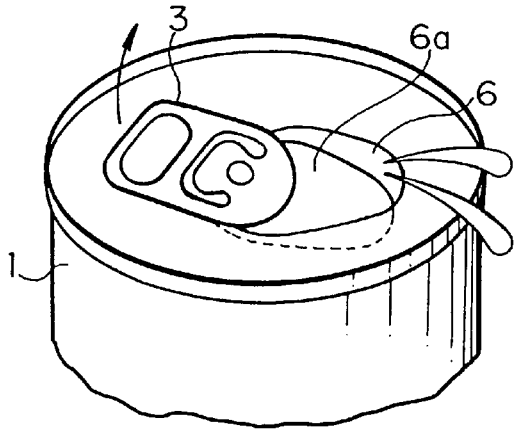
FIG. 12 is a view showing the prior art can in a different state.

FIG. 10 shows an example, in which a seal 5A is applied to a can 1A containing processed food, such as beef or fish and shellfish. The can 1A of this type is usually opened by substantially entirely removing the circular top lid 4A. In correspondence to this, the seal 5A is substantially circular.

With the provision of the seal 5 (or 5A) which is above to be peeled off, the tap is kept clean and can be opened by pulling and raising the pull top member 3 without the content being spattered to the outside and contaminating the surroundings. After drinking a certain proportion of the contents, the can can be stored again by covering the tap with the seal 5 (or 5A) again. Covering the tap again with the seal (or 5A) and attaching the seal again to the can with the adhesive after fully drinking the contents, eliminates the possibility of occasional injury.

Further, the pull portion 5*b* of the seal 5 (or 5A) can be readily pinched and permits the seal 5 (or 5A) to be readily peeled off. The anti-bacterial seal can suppress intrusion or propagation of bacteria and is very sanitary. The adhesive containing anti-bacterial agent can suppress intrusion and propagation of bacteria. Further by providing the seal 5 (or 5A) with the pleat portion 5*a* which is bonded to the cylindrical body of the can 1 (or 1A), it is possible to substantially perfectly prevent intrusion of contaminants into the can.

The seal material formed as a film is typically made from a variety of materials consisting of polyvinyl chloride, polyethylene, polycarbonate, polypropylene, polyester, and fluroplastics, or combinations thereof.

Generally, adhesive materials used with the seal material are acrylic resin or urethane rubber based adhesives. One example is a product ONE TAX N made by the 3M company. This product allows continued re-adhesion after removal from the position of adhesion. Anther example is T. G. SHEET made by Motida Syoukou K.K. This product allows repeated use by layering an adhering elastomer on a film like seal material.

Anti-bacterial properties for the seal are provided by anti-bacterial agents exemplified by such metals as silver, copper, zinc, and tin and organic and inorganic compounds containing these metals. In consideration of any concern relative to safety issues, silver inorganic and copper inorganic anti-bacterial agents are preferable. An example of an available commercial product suitable for this purpose is NOVARON made by TOA GOSEI Co. Ltd. A preferable and cost effective method of providing an anti-bacterial agent in the present invention is to mix and disperse the anti-bacterial agent containing silver or copper ions with the seal material and adhesive.

Another example of providing the anti-bacterial properties to the present invention is to mix a powdered plant-derivative substance such as garlic, Japanese horseradish or green tea leaves (catechin as an effective constituent) with the adhesive material. An anti-bacterial agent made of Japanese horseradish is known as having an excellent effect against 0157 bacterium. An agent known in the art is WASABI POWER made by SEKISUI PLASTICS Co. Ltd. The product is made by making the WASABI oil to sheet or by kneading in a polyethylene film. The anti-bacterial content of WASABI gradually vaporizes to suppress the propagation for bacteria such as *Escherichia coli*.

A further example of an anti-bacterial film is disclosed in Japanese Patent 1988-154746 which dispenses specified solid zeolite particles having anti-bacterial metal ions such as silver, copper and zinc and a moisture absorbent in a synthetic resin. Moisture absorbents include calcium chloride, sodium chloride, potassium carbonate, magnesium sulfate and cane sugar.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described

What is claimed is:

1. A can with a seal comprising:

a can having a top lid, the top lid having a pull top member and an open portion therein;

a seal provided with an adhesive including an anti-bacterial agent on an inside surface of the seal, the inside surface of the seal being detachably attached to the top lid of the can having the pull top member, wherein the seal covers the open portion of the can, the open portion of the can being opened by raising the pull top member such that the member is pressed down and the open portion serves as a tap, and wherein the seal remains adhesively attached to the top lid of the can to prevent its contents from splashing out of the can.

2. The can with a seal according to claim 1, wherein the seal is reusable.

3. The can with a seal according to claim 1, wherein the seal has a pleat portion for bonding to the can and the pleat portion of the seal depends from an arcuate edge of the can and extends down to a portion of the can to be touched by a human subject's lower lip.

4. The can with a seal according to claim 1, wherein the seal is substantially semi-circular and has a pull portion.

5. The can with a seal according to claim 4, wherein the seal is a polymeric material.

* * * * *